US008287046B1

(12) United States Patent
Wang

(10) Patent No.: US 8,287,046 B1
(45) Date of Patent: Oct. 16, 2012

(54) EASY-TO-ASSEMBLE/RECYCLE ARMREST

(75) Inventor: Ching-Chang Wang, Taichung (TW)

(73) Assignee: Chuan Hsing Chemical Industry Co., Ltd., Taichung (TW)

( * ) Notice: Subject to any disclaimer, the term of this patent is extended or adjusted under 35 U.S.C. 154(b) by 0 days.

(21) Appl. No.: 13/210,542

(22) Filed: Aug. 16, 2011

(30) Foreign Application Priority Data

May 6, 2011 (TW) ..... 100208193 U

(51) Int. Cl.
*A47C 7/54* (2006.01)

(52) U.S. Cl. ..... 297/411.26; 297/411.31

(58) Field of Classification Search ..... 297/411.37, 297/411.38, 411.2, 411.26, 411.31, 440.1, 297/411.35
See application file for complete search history.

(56) References Cited

U.S. PATENT DOCUMENTS

| | | | | |
|---|---|---|---|---|
| 5,749,628 | A * | 5/1998 | Synder et al. | 297/411.36 |
| 6,074,012 | A * | 6/2000 | Wu | 297/411.26 |
| 6,106,070 | A * | 8/2000 | Ritt et al. | 297/411.35 |
| 6,168,236 | B1 | 1/2001 | Chen | |
| 6,502,904 | B1 * | 1/2003 | Hansen | 297/411.35 |
| 7,559,609 | B2 * | 7/2009 | Tsai | 297/411.35 |
| 7,648,207 | B2 * | 1/2010 | Lai | 297/411.31 |

* cited by examiner

*Primary Examiner* — Milton Nelson, Jr.
(74) *Attorney, Agent, or Firm* — Alan Kamrath; Kamrath IP Lawfirm, PA

(57) ABSTRACT

An armrest includes a base and an arm support. The base has a connecting portion and an installing portion. A first surface at an end of the connecting portion is opposite to the installing portion. The arm support is adapted to assemble with the base, and the arm support is pivotable with respect to the base. The arm support includes a second surface abutting the first surface, with a cavity defined in one of the first and second surfaces. An engaging member is pivotally received in the cavity in a single pivoting direction from an unlocked position to a locked position. The arm support is fixed to the base in the locked position.

18 Claims, 13 Drawing Sheets

EASY-TO-ASSEMBLE/RECYCLE ARMREST

BACKGROUND

1. Field of the Invention

An armrest is shown with a base and an arm support, and, in particular, an armrest is shown which can be assembled easily and quickly.

2. Description of the Related Art

Various universal chair armrests usually comprise a base connected to an armrest support. One end of the armrest support is installed at a chair, and the base is formed on another end of the armrest support. Although this design reduces time to install the base to the armrest support, the manufacturing process of the chair armrest is very inconvenient. The mold of the chair armrest manufactured into a one-piece structure is difficult to bring about, thereby increasing manufacturing costs.

U.S. Pat. No. 6,168,236 discloses an armrest including a lower cover with a number of retainer rings and an upper cover mounted on top of the lower cover. A plurality of metal nut fasteners is mounted in the retainer rings, respectively. Each nut fastener has a screw hole to allow the armrest to be mounted to a base by screws. A plurality of engaging plates is provided for securely engaging the upper cover with the lower cover. The metal nut fasteners can be removed by machinery, but it is inconvenient to remove the plurality of nut fasteners in the disassembly process.

Therefore, there is a need for an armrest that overcomes the above problems and that provides an inexpensive, secure attachment which does not require fasteners or precise tolerances. Further, an armrest is desired that allows for quick attachment without use of complex machinery. Still further, there is a need for an armrest that does not become loose over a period of time and also that provides an uncluttered, aesthetically pleasing appearance.

Therefore, a need exists for an armrest intended to obviate or at least alleviate the problems encountered in the prior art.

SUMMARY

An armrest includes a base and an arm support. The base has a connecting portion and an installing portion formed at two opposite ends therein, with the installing portion adapted to install to a chair. A first surface is formed at an end of the connecting portion opposite to the installing portion. The arm support is assembled to the base, and the arm support is pivotable with respect to the base, with the arm support including a second surface opposite to the first surface of the base. A receiving space is defined in the second surface of the arm support. The arm support is pivotable with respect to the base between an unlocked position and a locked position. When the arm support is in the unlocked position, the second surface of the arm support abuts against the first surface of the base, with the receiving space receiving an engaging portion of the base. The arm support is pivotable with respect to the base in a single pivoting direction from the unlocked position to a locked position. When the arm support is in the locked position, the arm support is fixed to the base.

The base and the arm support are reliably assembled easily and quickly. With a pair of outer teeth members and a pair of inner teeth members in the unlocked position, the arm support is pivotable with respect to the base in a single pivoting direction. Furthermore, when the arm support is in the locked position, the pair of inner teeth members engage respectively with the pair of outer teeth members without use of complex machinery and without removing any fasteners.

Other objectives, advantages, and novel features will become more apparent from the following detailed description when taken in conjunction with the accompanying drawings.

BRIEF DESCRIPTION OF THE DRAWINGS

For the present disclosure to be easily understood and readily practiced, the present disclosure will now be described in conjunction with the following figures, wherein.

Figure 1:
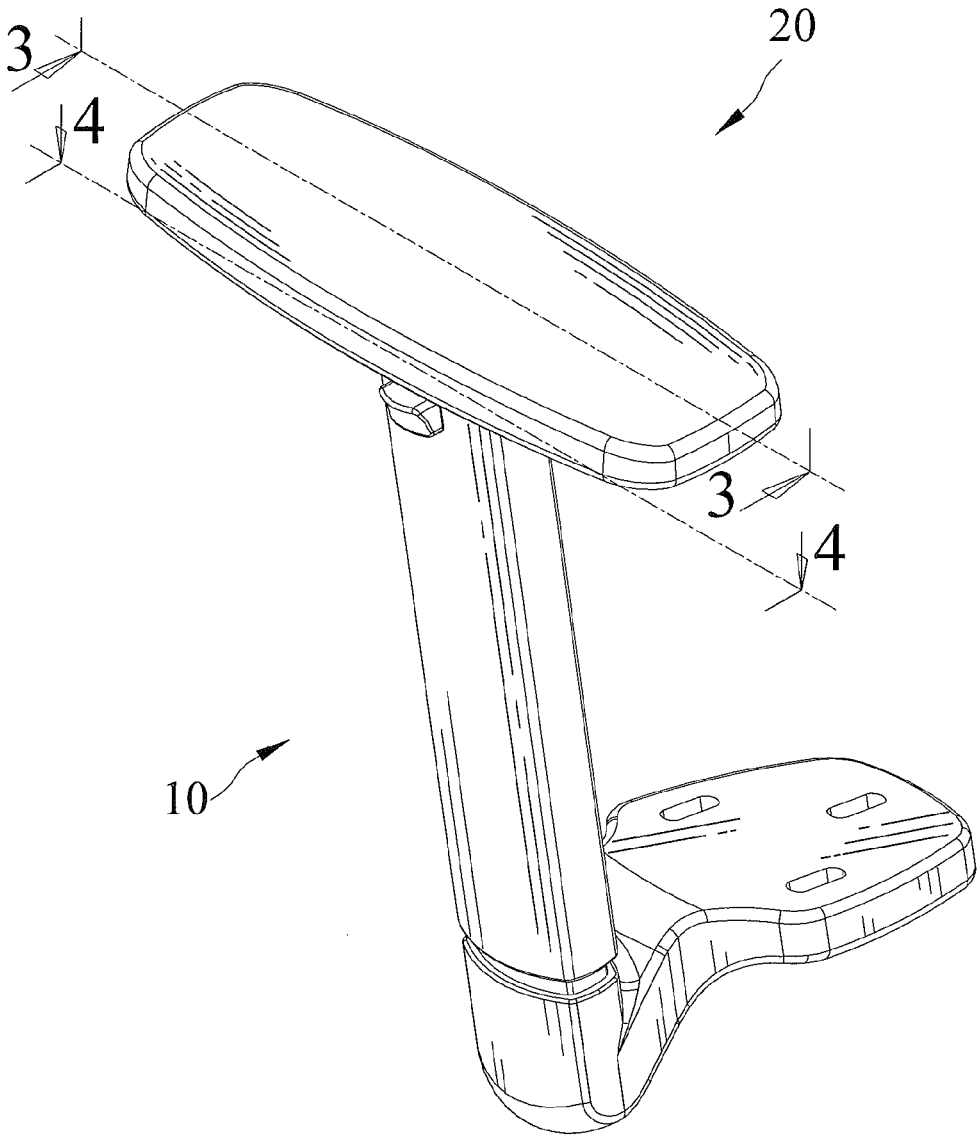
FIG. 1 is a perspective view of an armrest in accordance with a first embodiment.
Figure 2:
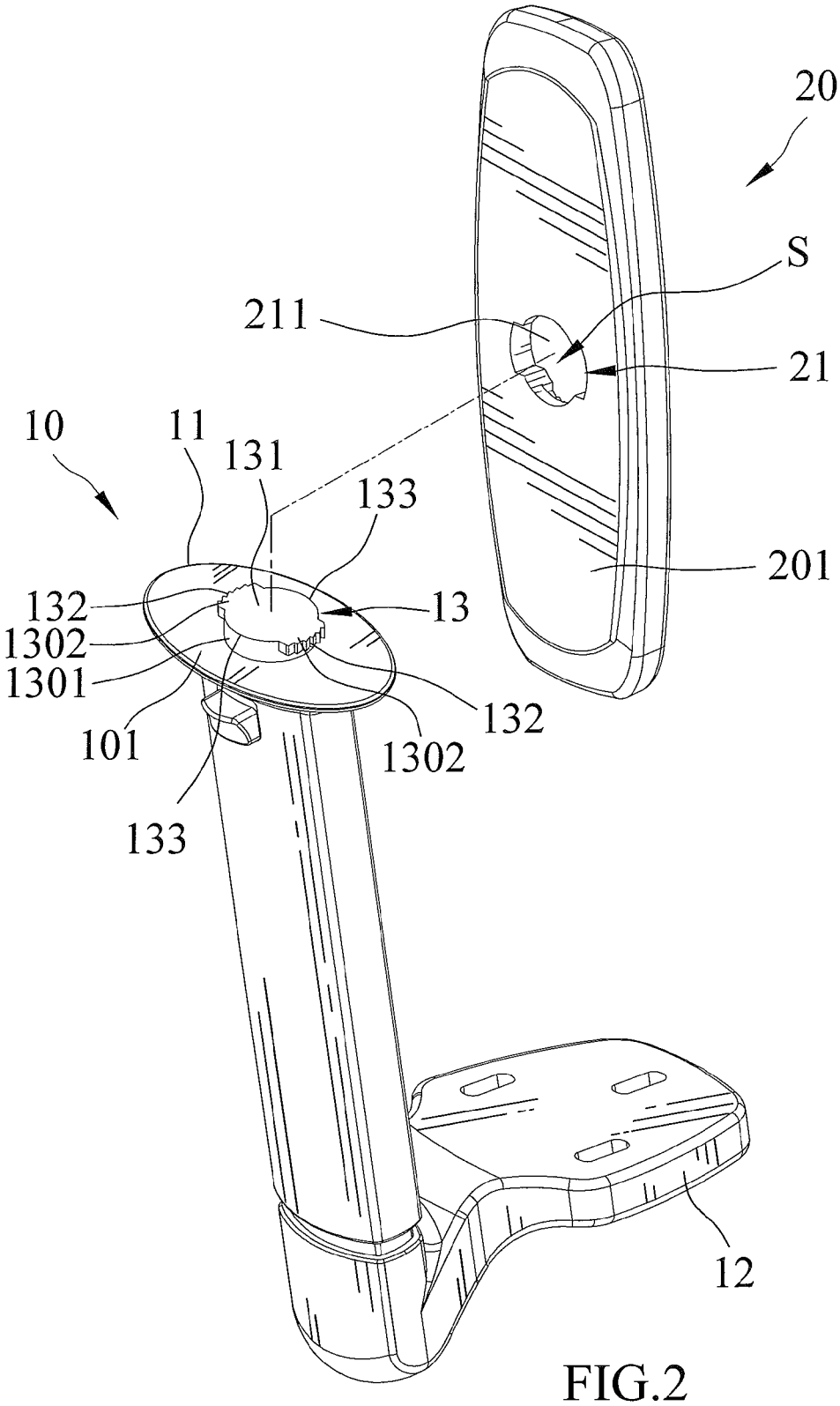
FIG. 2 is an exploded perspective view of the armrest of FIG. 1.
Figure 3:
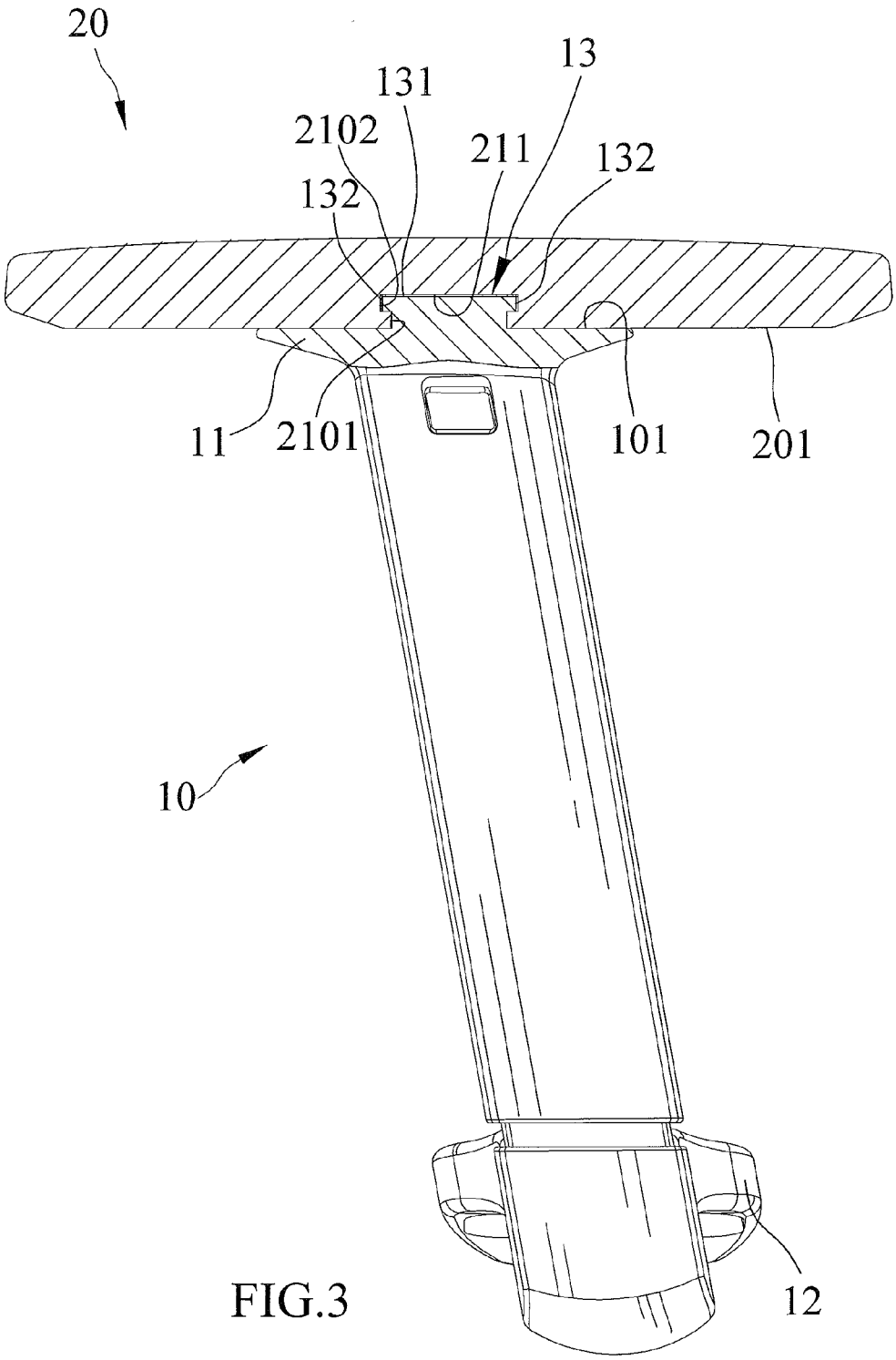
FIG. 3 is a cross sectional view taken along line 3-3 of the armrest of FIG. 1.
Figure 4:
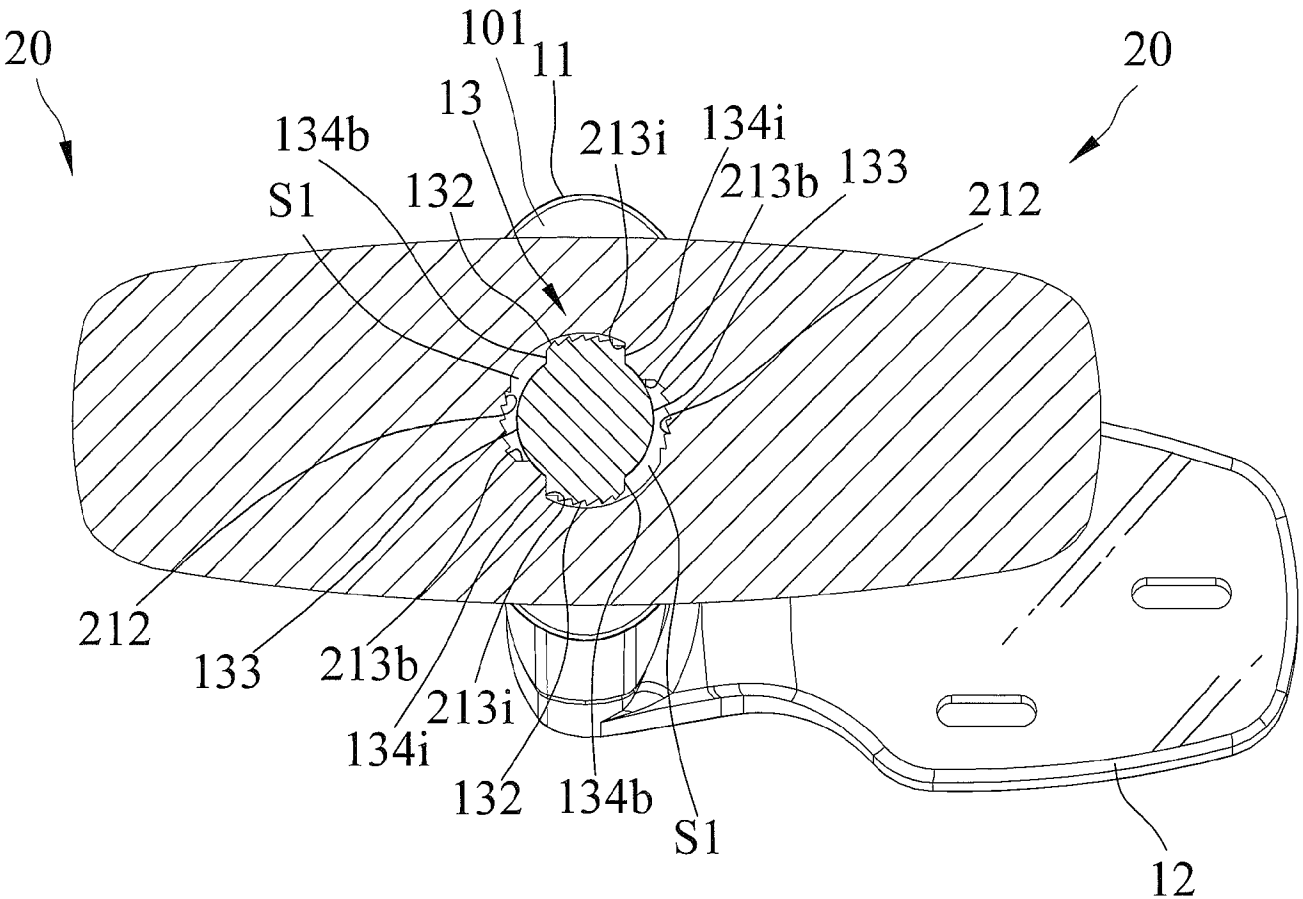
FIG. 4 is a cross sectional view taken along line 4-4 of the armrest of FIG. 1, illustrating an arm support in an unlocking position.
Figure 5:
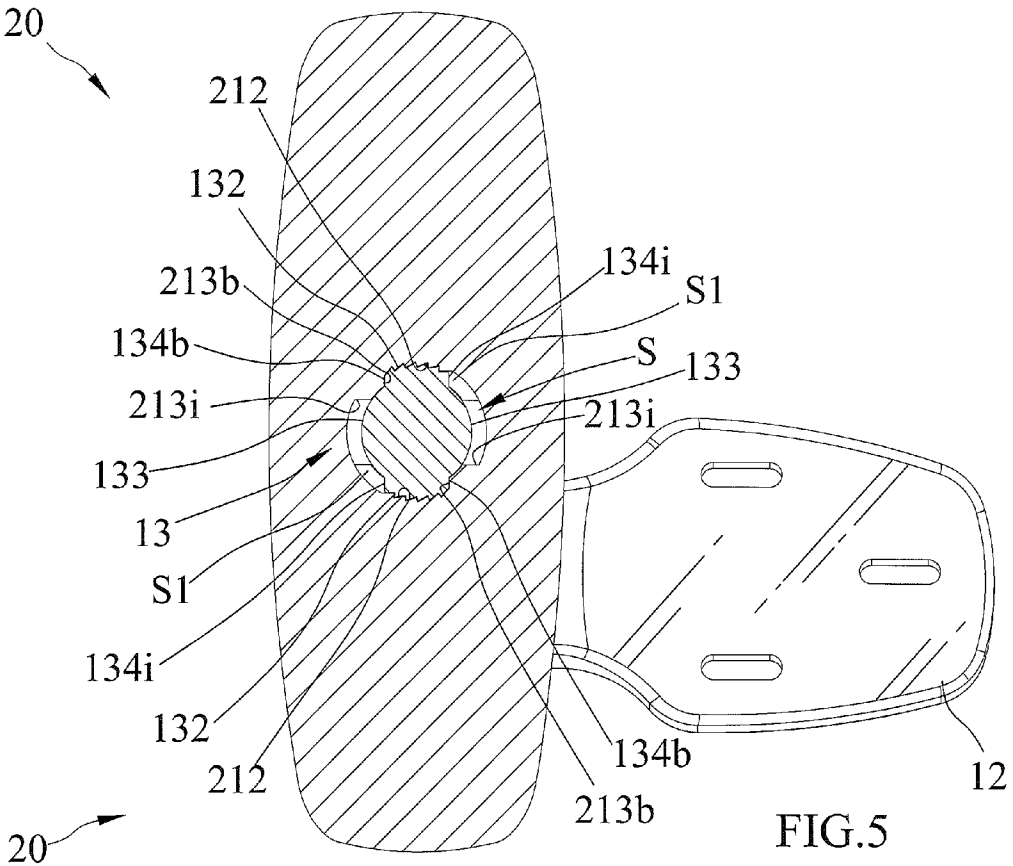
FIG. 5 is a cross sectional view similar to FIG. 4, illustrating an arm support in a locking position.

All figures are drawn for ease of explanation of the basic teachings only; the extensions of the Figures with respect to number, position, relationship, and dimensions of the parts to form illustrative embodiments will be explained or will be within the skill of the art after the following teachings have been read and understood. Further, the exact dimensions and dimensional proportions to conform to specific force, weight, strength, and similar requirements will likewise be within the skill of the art after the following teachings have been read and understood.

Where used in the various figures of the drawings, the same numerals designate the same or similar parts. Furthermore, when the terms "first", "second", "third", "fourth", "end", "portion", "section", "lateral", "peripheral", "inward", and similar terms are used herein, it should be understood that these terms have reference only to the structure shown in the drawings as it would appear to a person viewing the drawings and are utilized only to facilitate describing the illustrative embodiments.

DETAILED DESCRIPTION OF THE ILLUSTRATIVE EMBODIMENTS

Referring to FIGS. 1 through 5, an armrest according to the first embodiment includes a base 10 connected to an arm support 20. The base 10 and the arm support 20 are manufactured separately.

The base 10 has a connecting portion 11 and an installing portion 12, which are formed at two opposite ends of the base 10. The installing portion 12 is adapted for installing to a chair (not shown). A first surface 101 at an end of the connecting portion 11 is opposite to the installing portion 12, and an engaging portion 13 is formed thereon. The engaging portion 13 protrudes from the first surface 101 axially. The engaging portion 13 is generally T-shaped. Specifically, the engaging portion 13 includes a column portion 1301 and two radial portions 1302 radially extending oppositely from the column portion 1301 to a radial extent, with the radial portions 1302 being spaced from but parallel to the first surface 101. The engaging portion 13 includes an end face 131 opposite to the first surface 101. The engaging portion 13 includes a pair of outer teeth members 132 formed at two opposite sides of the radial portions 1302 of the engaging portion 13, respectively. Each of the pair of outer teeth members 132 has a plurality of teeth formed thereon, with each tooth being asymmetric. Each of the pair of outer teeth members 132 has an edge surface which is coplanar with the end face 131. The column portion 1301 of the engaging portion 13 includes two arc sections 133 respectively extending outward from a lateral side of one of the pair of outer teeth members 132 to a lateral side of another of the pair of outer teeth members 132. Each of the pair of outer teeth members 132 includes two blocking surfaces 134*i* and 134*b* adjacent to the arc sections 133.

The arm support 20 is adapted to assemble with the base 10, and the arm support 20 is pivotable with respect to the base 10. The arm support 20 includes a second surface 201 abutable with the first surface 101 of the base 10. A cavity 21 is defined in the second surface 201 of the arm support 20 axially. The cavity 21 includes a first inner portion 2101 spaced from the second surface 201 and a second inner portion 2102 interconnected between the first inner portion 2101 and the second surface 201.

The cavity 21 receives the engaging portion 13. The arm support 20 includes a capping surface 211 defining the axial end of the first inner portion 2101. When the cavity 21 receives the engaging portion 13, the capping surface 211 abuts against the end face 131. The second inner portion 2102 has a shape corresponding to and for axially slideably receiving the arc sections 133 and the radial portions 1302. The shape of the second inner portion 2102 is continued in the first inner portion 2101 to define a receiving space S in the cavity 21. The first inner portion 2101 of the cavity 21 includes two pivoting spaces S1 defined between the two opposite sides of the receiving space S and spaced from and parallel to the second surface 201. The pivoting spaces S1 have a radial extent to receive the outer teeth members 132 respectively. The pivoting spaces S1 of the cavity 21 include a pair of inner teeth members 212 formed at two opposite sides of the second inner portion 2102 of the cavity 21, with the pair of inner teeth members 212 adapted to engage the pair of outer teeth members 132, respectively. The pair of inner teeth members 212 and the pair of outer teeth members 132 restrict the arm support 20 to pivoting in relation to the base 10 in a single pivoting direction. The cavity 21 is defined by two pairs of blocking surfaces 213*i* and 213*b* adapted to abut the first blocking surfaces 134*i* and 134*b*, respectively. The receiving space S includes the two blocking surfaces 213*i*, and each of the pivoting spaces S1 include one of the blocking surfaces 213*b* circumferentially spaced from the two blocking surfaces 213*i* and axially spaced from the second surface 201.

The arm support 20 is pivotable in relation to the base 10 between an unlocked position and a locked position.

When the arm support 20 is in the unlocked position, the second surface 201 of the arm support 20 abuts against the first surface 101 of the base 10. The receiving space S of the cavity 21 receives the engaging portion 13 of the base 10. The capping surface 211 abuts against the end face 131 of the engaging portion 13. The blocking surfaces 213*i* are able to abut against the blocking surfaces 134*i*, respectively.

With the engaging portion 13 received in the receiving space S, the arm support 20 is able to pivot with respect to the base 10 to the locked position. When the arm support 20 is in the locked position, the pair of inner teeth members 212 engage with the pair of outer teeth members 132, respectively. The blocking surfaces 213*b* abut against the first blocking surfaces 134*b*, respectively. The radial portions 1302 abut against the walls defining the pivoting spaces S1 axially, so that the support 20 is not able to move longitudinally with respect to the base 10. The arm support 20 is fixed to the base 10.

When the arm support 20 is in the locked position, the arm support 20 is unable to pivot with respect to the base opposite to the single pivoting direction.

Figure 6:
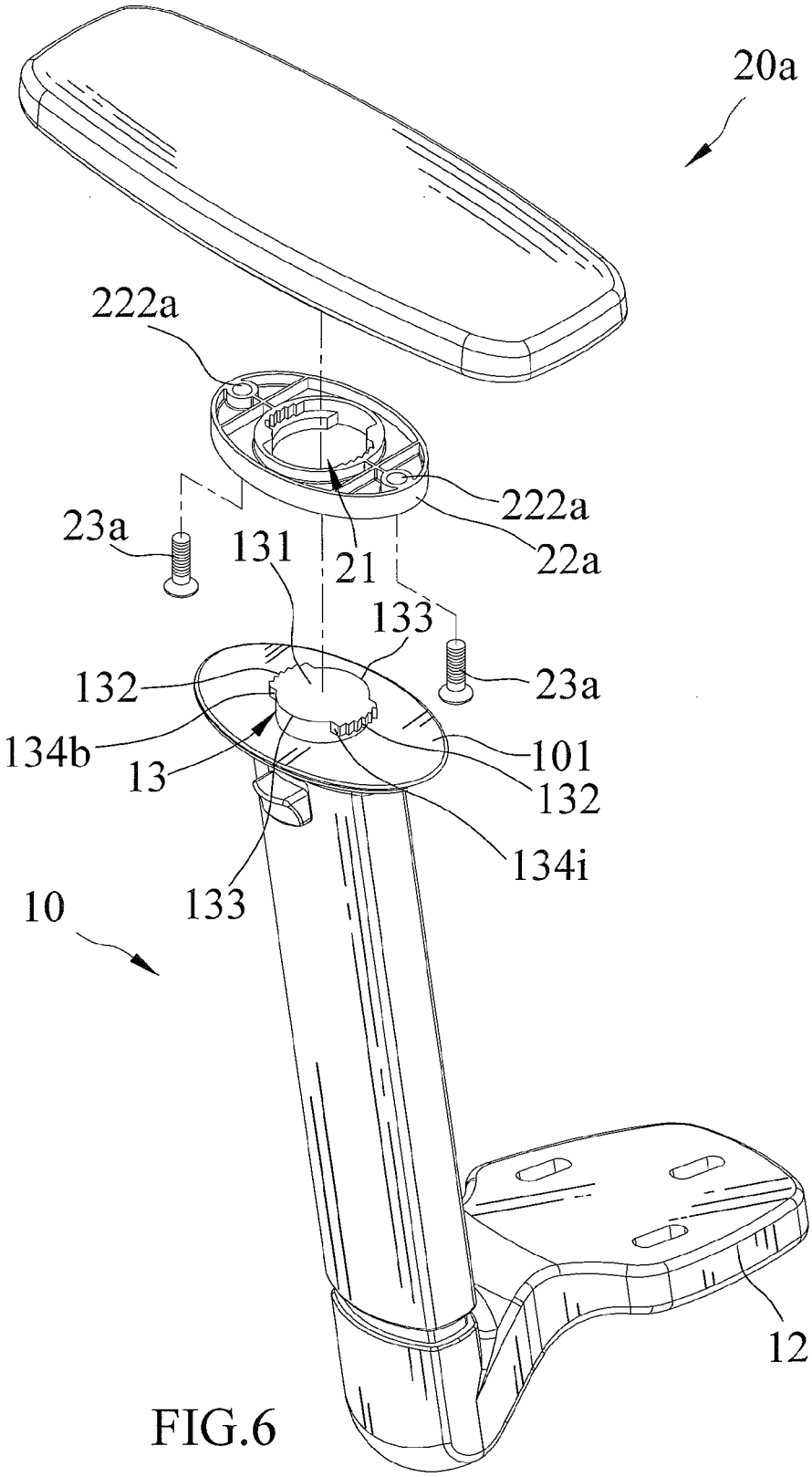
FIG. 6 is an exploded perspective view of an armrest in accordance with the second embodiment.
Figure 7:
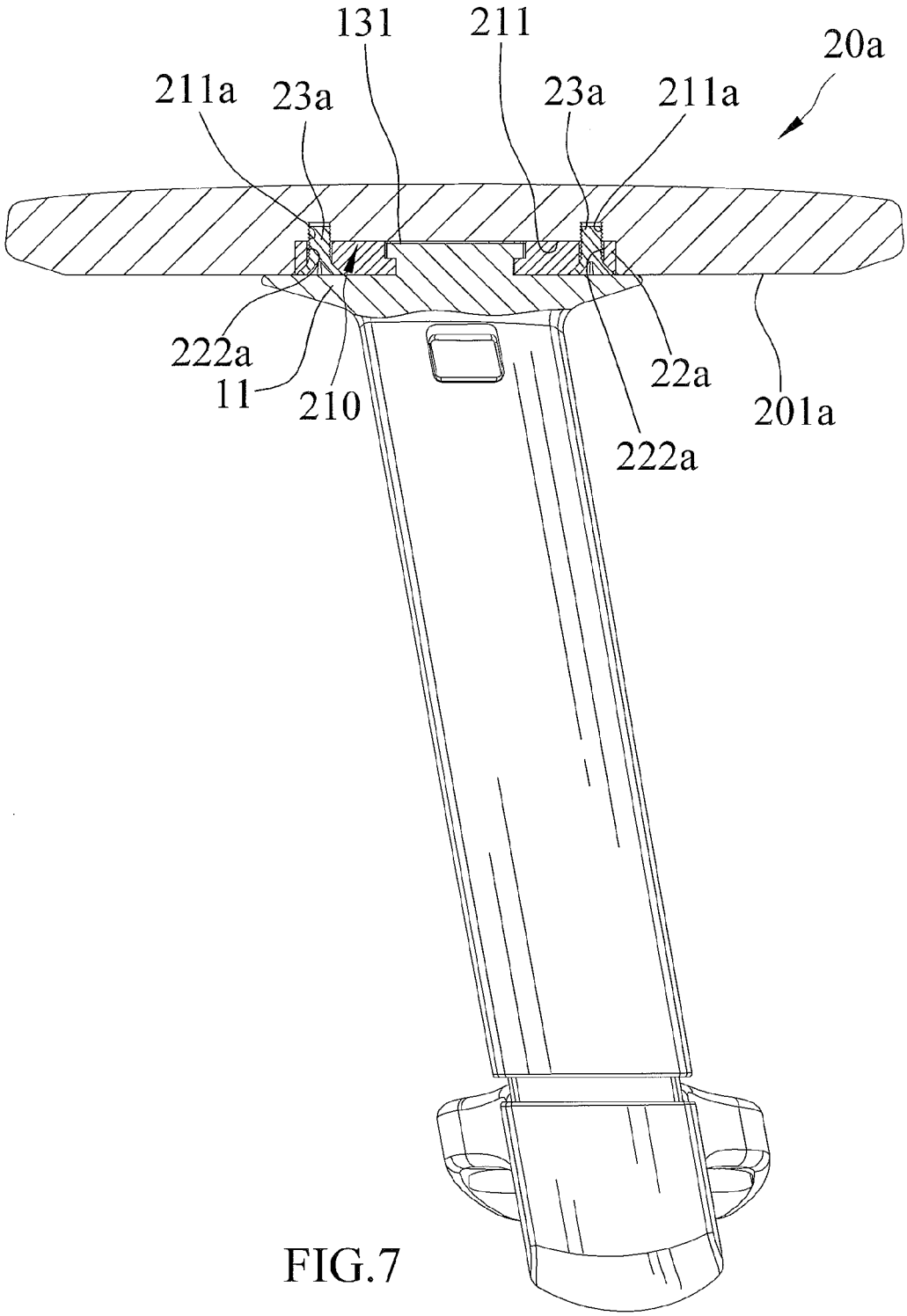
FIG. 7 is a cross sectional view of the armrest of FIG. 6.

Referring to FIGS. 6 and 7, an armrest according to the second embodiment includes a base 10 connecting to an arm support 20*a*. The base 10 and the arm support 20*a* are manufactured separately. The structure of the base 10 is similar to the first embodiment substantially.

The arm support 20*a* is adapted to assemble with the base 10. The arm support 20*a* is pivotable with respect to the base 10. The arm support 20*a* includes a second surface 201*a* abutable with the first surface 101 of the base 10. A socket 210 is defined in the second surface 201*a* of the arm support 20*a* axially. Two through bores 211*a* are defined respectively at the two opposite ends of the socket 210.

A connecting member 22*a* can be received in the socket 210. The connecting member 22*a* includes two through apertures 222*a* at the two opposite ends of the connecting member 22*a* in relation to the through bores 211*a*. Two fasteners 23*a* extend through the apertures 222*a* and the through bores 211*a*, respectively, to fix the connecting member 22*a* in the socket 210 of the arm support 20*a*.

The cavity 21 is formed in the connecting member 22*a*, with the capping surface 211 formed by the axial end of the socket 210.

Figure 8:
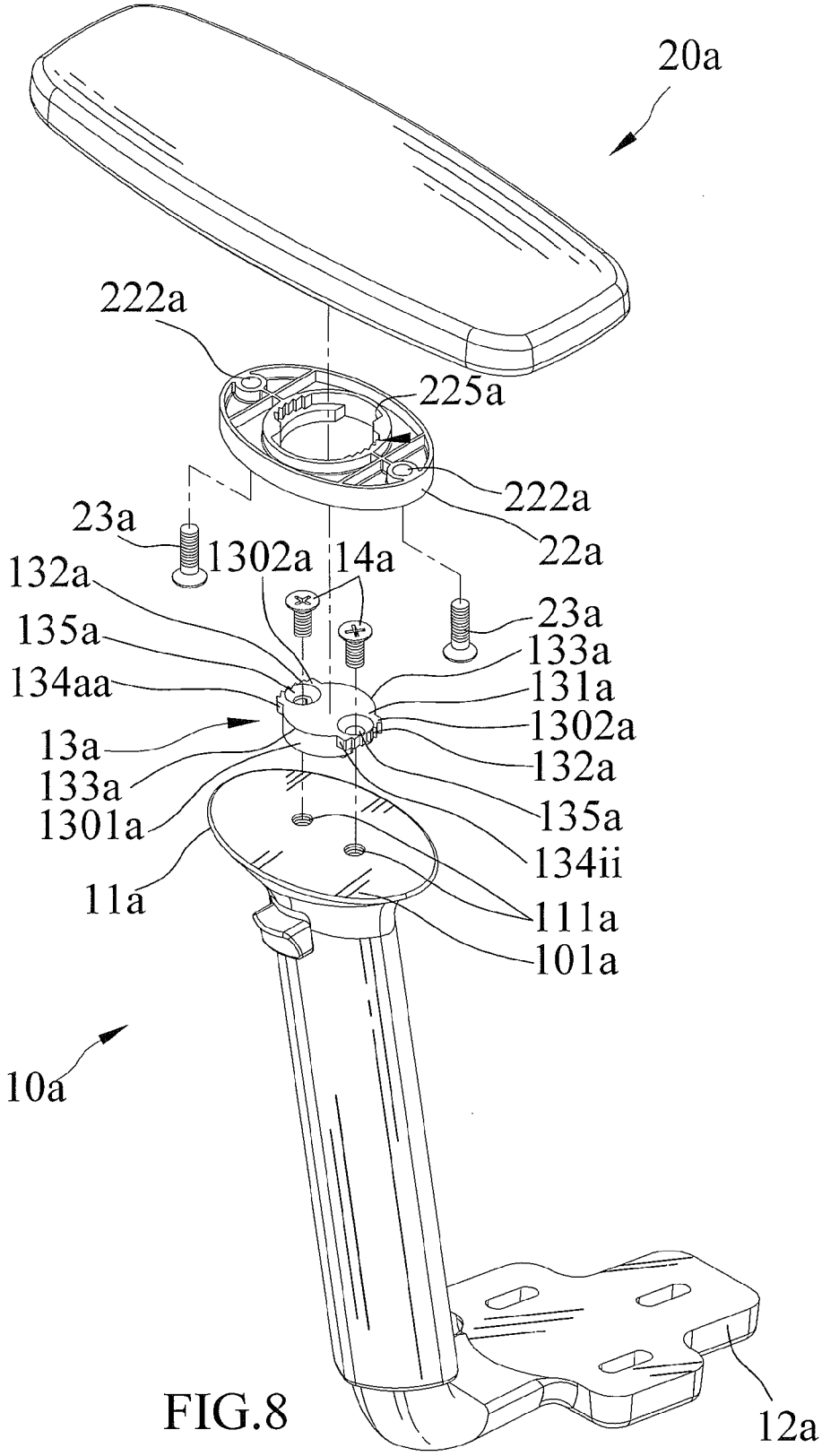
FIG. 8 is an exploded perspective view of an armrest in accordance with a third embodiment.
Figure 9:
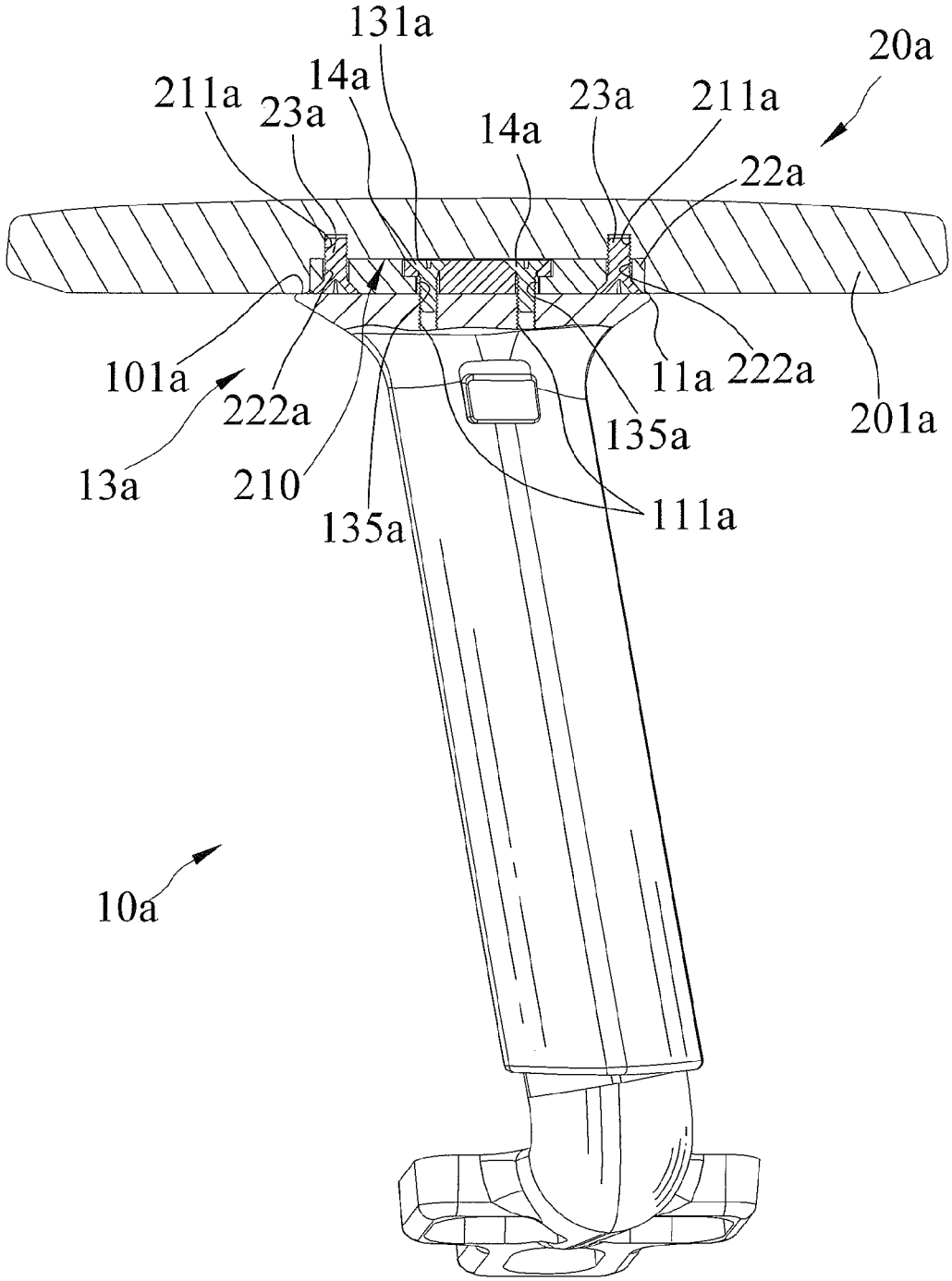
FIG. 9 is a cross sectional view of the armrest of FIG. 8.

Referring to FIGS. 8 and 9, an armrest according to the third embodiment includes a base 10*a* connecting to an arm support 20*a*. The base 10*a* and the arm support 20*a* are manufactured separately. The structure of the arm support 20*a* is similar to the second embodiment substantially.

The base 10*a* has a connecting portion 11*a* and an installing portion 12*a*, which are formed at two opposite ends of the base 10*a*. The installing portion 12*a* is adapted to install to a chair (not shown). A first surface 101*a* at an end of the connecting portion 11*a* is opposite to the installing portion 12*a*. The base 10*a* includes two holes 111*a* therein. The connecting portion 11*a* assembles with an engaging portion 13*a*. The engaging portion 13*a* is generally T-shaped. Specifically, the engaging portion 13*a* includes a column portion 1301*a* and two radial portions 1302*a* radially extending oppositely from the column portion 1301*a* to a radial extent. The engaging portion 13*a* includes an end face 131*a* opposite to the first surface 101*a*. The engaging portion 13*a* includes a pair of outer teeth members 132*a* formed at two opposite sides of the radial portions 1302*a* of the engaging portion 13*a*, respectively. Each of the pair of outer teeth members 132*a* has a plurality of teeth formed thereon, and each tooth is asymmetric. Each of the pair of outer teeth members 132*a* has an edge surface that is coplanar with the end face 131*a*. The column portion 1301*a* of the engaging portion 13*a* includes two arc sections 133*a* respectively extending outward from a lateral side of one of the pair of outer teeth members 132*a* to a lateral side of another of the pair of outer teeth members 132*a*. Each of the pair of outer teeth member 132*a* includes two blocking surfaces 134*ii* and 134*aa* adjacent to the arc sections 133*a*.

The engaging portion 13*a* further includes two axial holes 135*a* with respect to the holes 111*a*. Two fasteners 14*a* pass through the axial holes 135*a* and the holes 111*a*, respectively, to fix the engaging portion 13*a* to the connecting portion 11*a* of the base 10*a*. The radial portions 1302*a* are spaced from but parallel to the first surface 101*a*.

Figure 10:
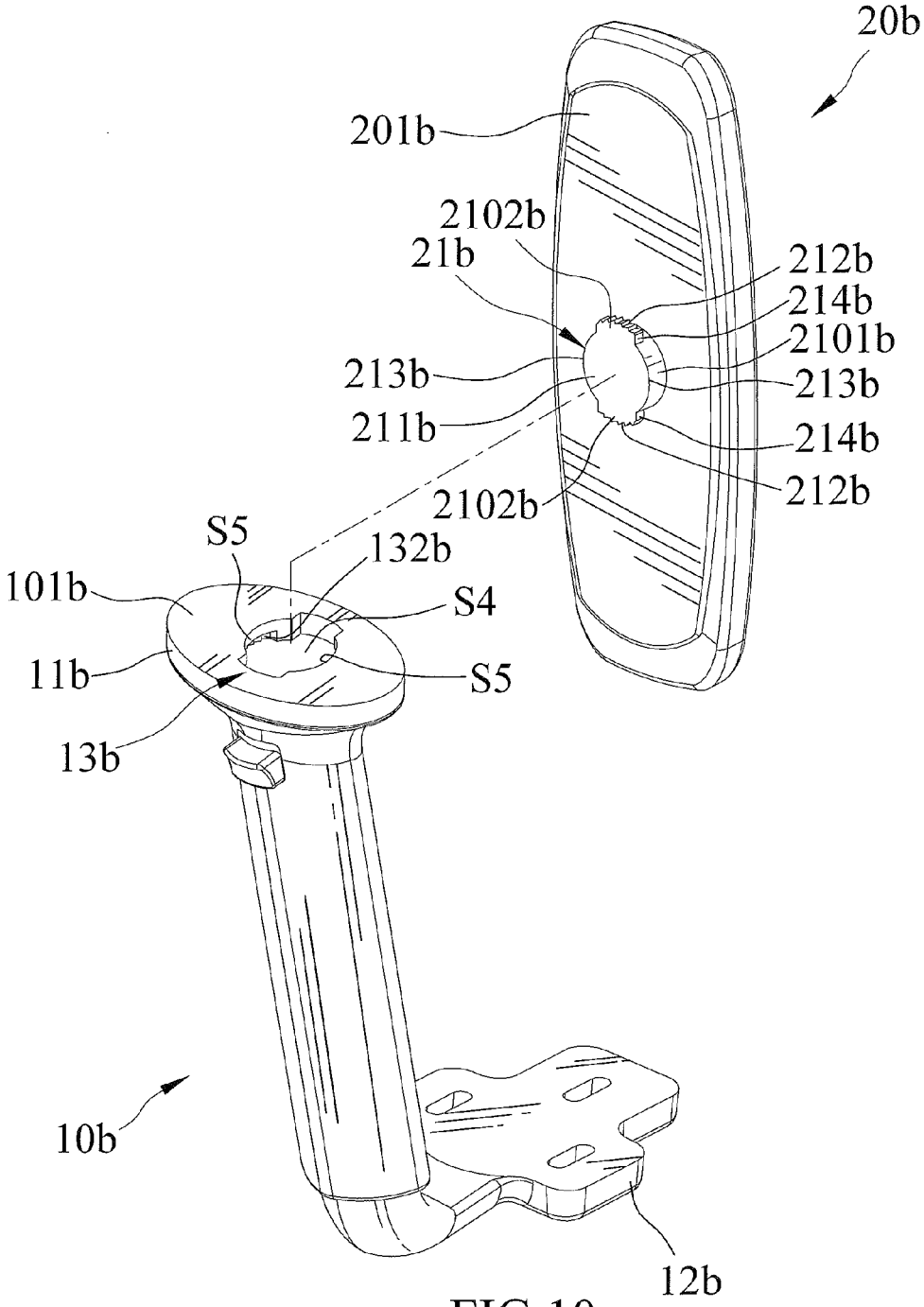
FIG. 10 is an exploded perspective view of an armrest in accordance with a fourth embodiment.
Figure 11:
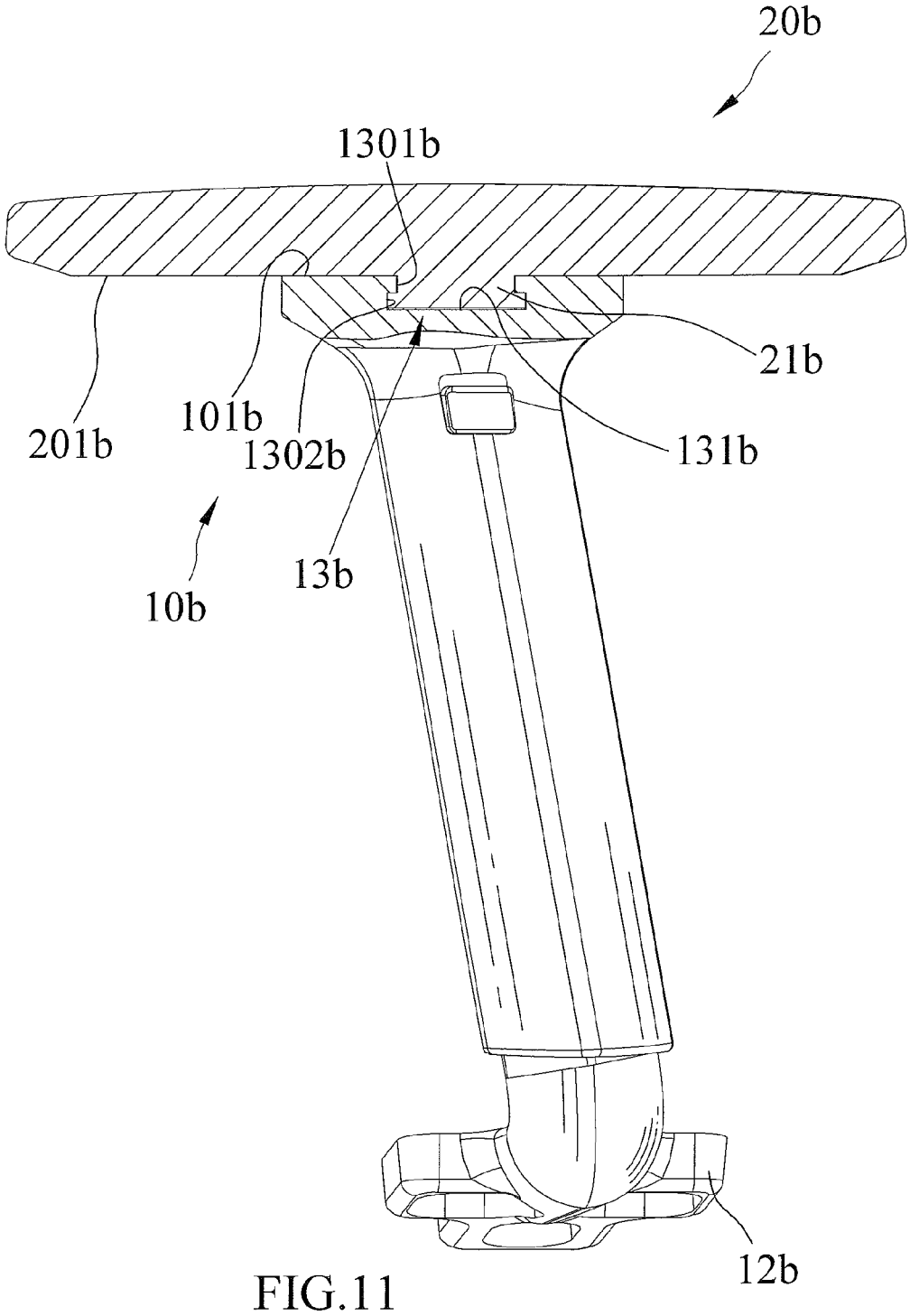
FIG. 11 is a cross sectional view of the armrest of FIG. 10.

Referring to FIGS. 10 and 11, an armrest according to the fourth embodiment includes a base 10*b* connecting to an arm support 20*b*. The base 10*b* and the arm support 20*b* are manufactured separately.

The arm support 20*b* is adapted to assemble with the base 10*b*, and the arm support 20*b* is pivotable with respect to the base 10*b*. The arm support 20*b* includes a second surface 201*b*. The second surface 201*b* of the arm support 20*b* is opposite to the base 10*b*, and an engaging portion 21*b* is formed thereon. The engaging portion 21*b* protrudes from the second surface 201*b* axially. The engaging portion 21*b* is generally T-shaped. The engaging portion 21*b* includes a column portion 2101*b* and two radial portions 2102*b* radially extending oppositely from the column portion 2101*b* to a radial extent, with the radial portions 2102*b* being spaced from but parallel to the second surface 201*b*. The engaging portion 21*b* includes an end face 211*b* opposite to the second surface 201*b*. The engaging portion 21*b* includes a pair of outer teeth members 212*b* formed at two opposite sides of the radial portions 2102*b* of the engaging portion 21*b*, respectively. Each of the pair of outer teeth members 212*b* has a plurality of teeth formed thereon, and each tooth is asymmetric. Each of the pair of outer teeth members 212*b* has an edge surface which is coplanar with the end face 211*b*. The column portion 2101*b* of the engaging portion 21*b* includes two arc sections 213*b* respectively extending outward from a lateral side of one of the two outer teeth members 212*b* to a lateral side of another of the pair of outer teeth member 212*b*. Each of the pair of outer teeth members 212*b* includes two first blocking surfaces 214*b* adjacent to the arc sections 213*b*.

The base 10*b* has a connecting portion 11*b* and an installing portion 12*b* formed at two opposite ends of the base 10*b*. The installing portion 12*b* is adapted to install to a chair (not shown). A first surface 101*b* at an end of the connecting portion 11*b* is opposite to the installing portion 12*b*. A cavity 13*b* is defined in the first surface 101*b* of the base 10*b* axially. The cavity 13*b* includes a first inner portion 1301*b* spaced from the first surface 101*b* and a second inner portion 1302*b* interconnected between the first inner portion 1301*b* and the first surface 101*b*.

The cavity 13*b* receives the engaging portion 21*b* of the arm support 20*b*. The cavity 13*b* includes a capping surface 131*b* defining the axial end of the first inner portion 1301*b*. When the cavity 13*b* receives the engaging portion 21*b*, the capping surface 131*b* abuts against the end face 211*b*. The second inner portion 1302*b* has a shape corresponding to and for axially slideably receiving the arc sections 213*b* and the radial portions 2102*b*. The shape of the second inner portion 1302*b* is continued in the first inner portion 1301*b* to define a receiving space S4 in the cavity 13*b*. The first inner portion 1301*b* of the cavity 13*b* includes two pivoting spaces S5 defined between the two opposite sides of the receiving space S4 and spaced from and parallel to the first surface 101*b*. The pivoting spaces S5 have a radial extent to receive the outer teeth members 212*b* respectively. The pivoting spaces S5 of the cavity 13*b* includes a pair of inner teeth members 132*b* formed at two opposite sides of the second inner portion 1302*b* of the cavity 13*b*, with the pair of inner teeth members 132*b* adapted to engage the pair of outer teeth members 212*b*, respectively. The pair of inner teeth members 132*b* and the pair of outer teeth members 212*b* restrict the arm support 20*b* to pivot in relation to the base 10*b* in a single pivoting direction.

Figure 12:
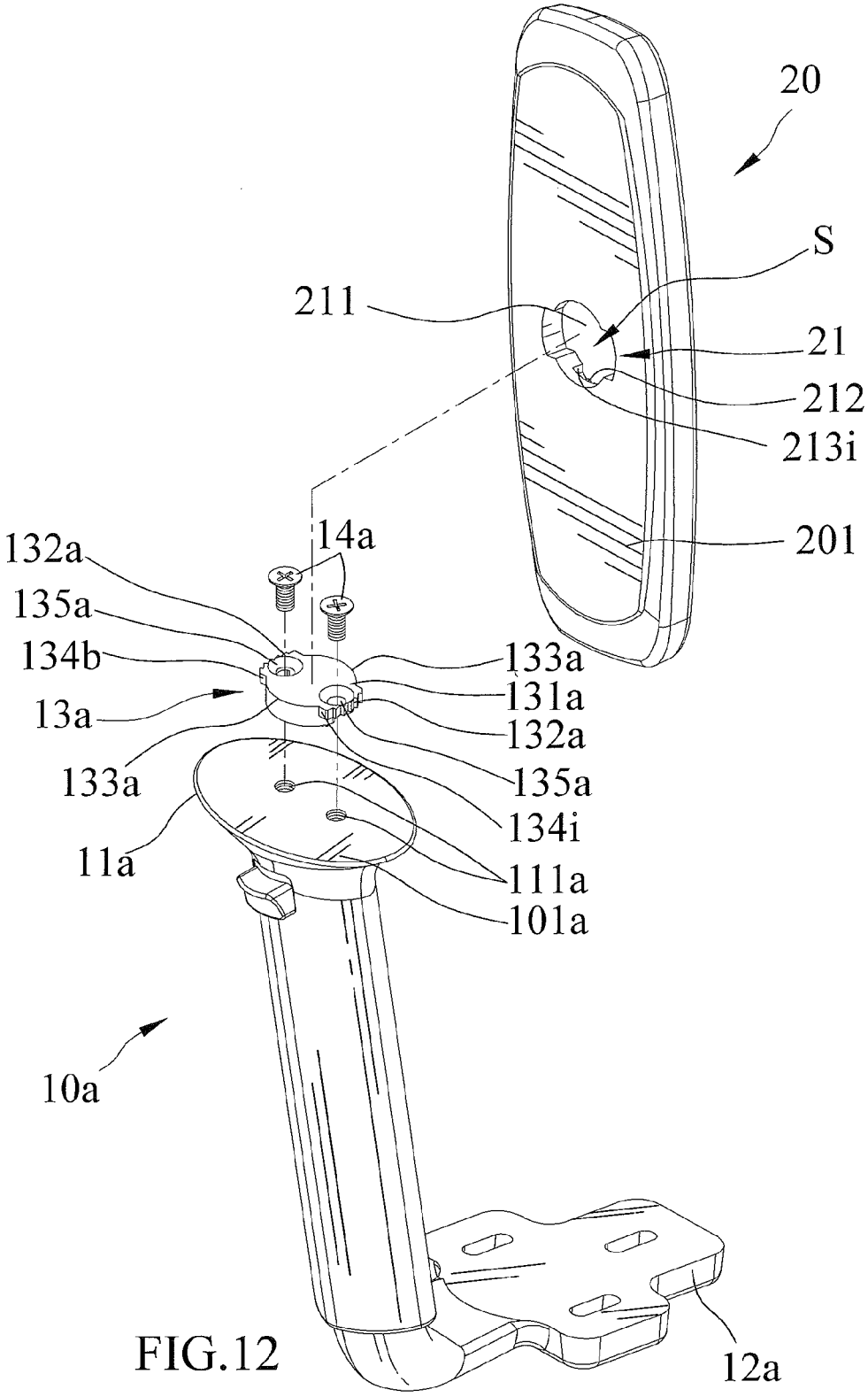
FIG. 12 is an exploded perspective view of an armrest in accordance with a fifth embodiment.
Figure 13:
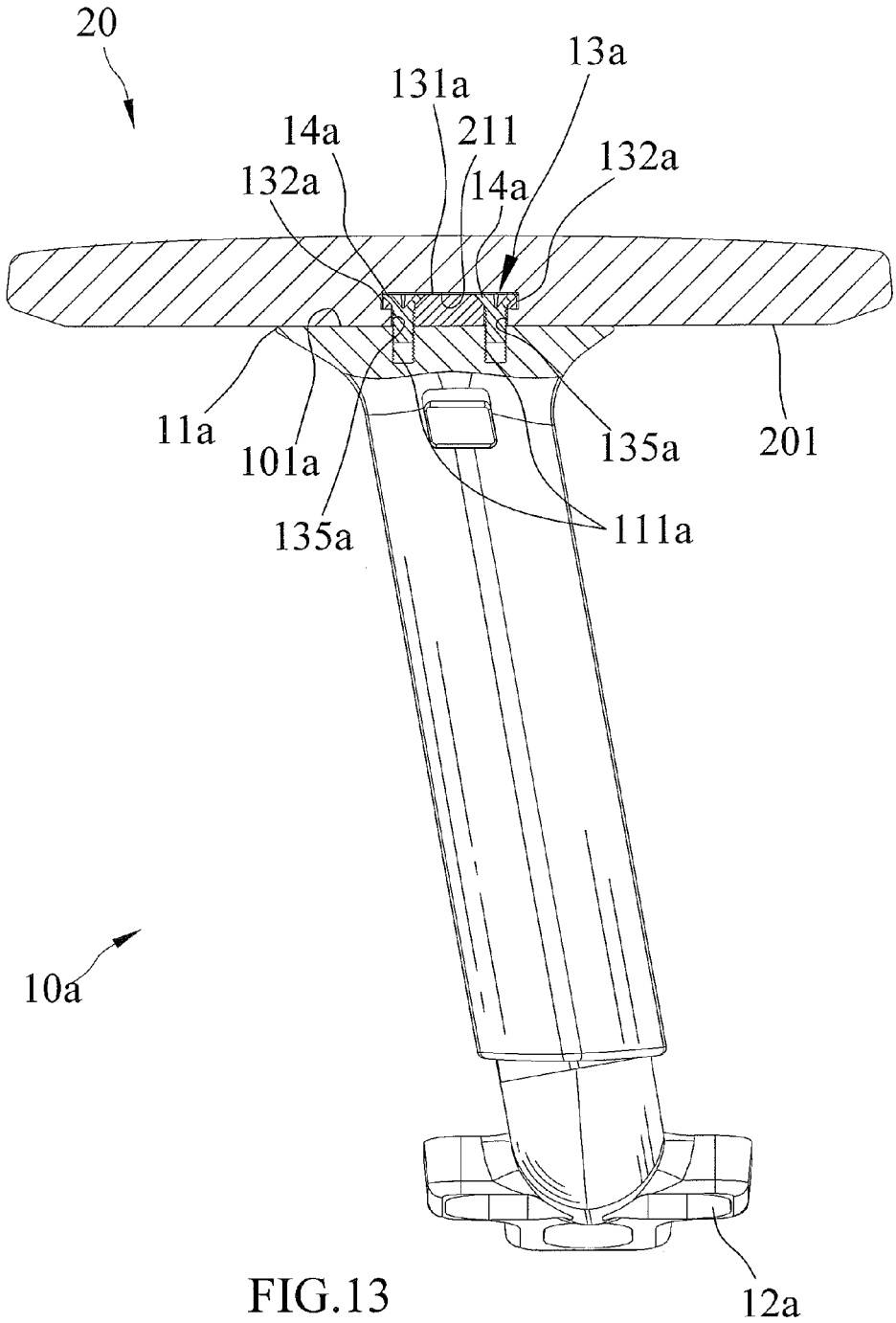
FIG. 13 is a cross sectional view of the armrest of FIG. 12.

Referring to FIGS. 12 and 13, an armrest according to the fifth embodiment includes a base 10*a* connected to an arm support 20. The base 10*a* and the arm support 20 are manufactured separately. The structure of the base 10*a* is similar to the third embodiment substantially, and the structure of the arm support 20 is similar to the first embodiment substantially.

While the specific embodiments have been illustrated and described, numerous modifications come to mind without significantly departing from the spirit of invention, and the scope of invention is only limited by the scope of the accompanying claims.

What is claimed is:

1. An armrest comprising:

a base including a connecting portion and an installing portion formed at two opposite ends of the base, with the installing portion adapted for installing to a chair, with a first surface at an end of the connecting portion opposite to the installing portion;

an arm support supported on the base, with the arm support including a second surface abutting the first surface of the base;

a cavity defined in one of the first and second surfaces; and an engaging portion formed on another of the first and second surfaces and pivotably received in the cavity, wherein the engaging portion is pivotable in the cavity in a single pivoting direction between an unlocked position and a locked position, wherein the arm support is fixed to the base in the locked position.

2. The armrest as claimed in claim 1 wherein the cavity is formed in the first surface of the base, wherein the base and the cavity are formed integrally as a single piece.

3. The armrest as claimed in claim 1 wherein the engaging portion is integrally formed as a single piece with the first surface of the base.

4. The armrest as claimed in claim 3 wherein the cavity is formed in the second surface of the arm support, wherein the arm support and the cavity are formed integrally as a single piece.

5. The armrest as claimed in claim 1 wherein the engaging portion is integrally formed as a single piece with the second surface of the arm support.

6. The armrest as claimed in claim 5 wherein the cavity is formed in the first surface of the base, wherein the base and the cavity are formed integrally as a single piece.

7. The armrest as claimed in claim 1 wherein the engaging portion includes an end face opposite the other of the first and second surfaces.

8. The armrest as claimed in claim 7 wherein the engaging portion includes a pair of outer teeth members formed at two opposite sides of the engaging portion, with each outer teeth member including first and second blocking surfaces.

9. The armrest as claimed in claim 8 wherein the cavity includes a pair of inner teeth members formed at two opposite sides of the cavity engaging with the pair of outer teeth members, respectively, with the pair of inner teeth members and the pair of outer teeth members restricting the engaging portion to pivot with respect to the cavity in the single pivoting direction, with the cavity defining third and fourth blocking surfaces abutting the first and second blocking surfaces;

wherein the pair of inner teeth members engage with the pair of outer teeth members, respectively, in the locked position with the third and fourth blocking surfaces abutting against the first and second blocking surfaces, respectively, with the arm support fixed to the base.

10. The armrest as claimed in claim 8 wherein a socket is defined in the one of the first and second surfaces axially, with two through bores defined respectively at two opposite ends of the socket, with a connecting member received in the socket, with the connecting member including the cavity, with the connecting member further including two through apertures at two opposite ends of the connecting member in relation to the two through bores;

wherein two fasteners pass through the two through apertures and the two through bores, respectively, to fix the connecting member in the socket.

11. The armrest as claimed in claim 10 wherein the cavity includes a capping surface; wherein the capping surface abuts against the end face, wherein the cavity includes two pivoting spaces defined between two sides of the cavity, respectively, with the two pivoting spaces receiving the pair of outer teeth members respectively, with the cavity including the pair of inner teeth members formed at the two pivoting spaces and engaging the pair of outer teeth members, with the cavity defining third and fourth blocking surfaces abutting against the first and second blocking surfaces.

12. The armrest as claimed in claim 11 wherein the engaging portion is integrally formed as a single piece with the first surface of the base.

13. The armrest as claimed in claim 1 wherein the other of the first and second surfaces includes two holes therein, with the engaging portion further including two axial holes with respect to the two holes, respectively, with two fasteners passing respectively through the two axial holes and the two holes to fix the engaging portion to the other of the first and second surfaces.

14. The armrest as claimed in claim 13 wherein the engaging portion includes a pair of outer teeth members formed at two opposite sides of the engaging portion, with each outer teeth member including first and second blocking surfaces.

15. The armrest as claimed in claim 14 wherein the cavity includes a pair of inner teeth members formed at two opposite sides of the cavity engaging with the pair of outer teeth members, respectively, with the pair of inner teeth members and the pair of outer teeth members restricting the engaging portion to pivot with respect to the cavity in the single pivoting direction, with the cavity defining third and fourth blocking surfaces abutting against the first and second blocking surfaces;

wherein the pair of inner teeth members engage with the pair of outer teeth members, respectively, in the locked position with the third and fourth blocking surfaces abutting against the first and second blocking surfaces, with the arm support fixed to the base.

16. The armrest as claimed in claim 15 wherein the cavity is formed in the second surface of the arm support, wherein the arm support and the cavity are formed integrally as a single piece.

17. The armrest as claimed in claim 15 wherein a socket is defined in the one of the first and second surfaces axially, with two through bores defined respectively at two opposite ends of the socket, with a connecting member received in the socket, with the connecting member including the cavity, with the connecting member further including two through apertures at two opposite ends of the connecting member in relation to the two through bores;

wherein two fasteners pass through the two through apertures and the two through bores, respectively, to fix the connecting member in the socket.

18. The armrest as claimed in claim 17 wherein the cavity includes a capping surface; wherein the capping surface abuts against the end face, wherein the cavity includes two pivoting spaces defined between two sides of the cavity, respectively, with the two pivoting spaces receiving the pair of outer teeth members respectively, with the cavity including the pair of inner teeth members formed at the two pivoting spaces and engaging the pair of outer teeth members, with the cavity defining third and fourth blocking surfaces abutting against the first and second blocking surfaces.

* * * * *